US009072413B2

(12) United States Patent
Fredankey, Sr.

(10) Patent No.: US 9,072,413 B2
(45) Date of Patent: Jul. 7, 2015

(54) STORAGE CONTAINER FOR BATHROOM CLEANING UTENSILS

(71) Applicant: Devon Peteroy Fredankey, Sr., Brooklyn, NY (US)

(72) Inventor: Devon Peteroy Fredankey, Sr., Brooklyn, NY (US)

( * ) Notice: Subject to any disclaimer, the term of this patent is extended or adjusted under 35 U.S.C. 154(b) by 0 days.

(21) Appl. No.: 14/014,289

(22) Filed: Aug. 29, 2013

(65) Prior Publication Data

US 2014/0076757 A1 Mar. 20, 2014

Related U.S. Application Data

(60) Provisional application No. 61/694,558, filed on Aug. 29, 2012.

(51) Int. Cl.
*A47K 17/00* (2006.01)

(52) U.S. Cl.
CPC ..... *A47K 17/00* (2013.01)

(58) Field of Classification Search
CPC ..... A47K 17/00; A47K 11/10; A46B 17/02; A46B 17/04; A47B 96/04
USPC ..... 206/361, 207, 209, 15.3, 15.2, 349; 312/206, 207
See application file for complete search history.

(56) References Cited

U.S. PATENT DOCUMENTS

| | | | | | |
|---|---|---|---|---|---|
| 4,008,933 | A * | 2/1977 | Wanek | 312/206 |
| 5,924,566 | A * | 7/1999 | Gibbs | 206/361 |
| 5,971,141 | A * | 10/1999 | Shafik | 206/225 |
| 5,984,100 | A * | 11/1999 | Ramsey et al. | 206/581 |
| 6,003,964 | A * | 12/1999 | Baker | 312/206 |
| 6,460,697 | B1 * | 10/2002 | Stevens | 206/225 |
| 6,702,113 | B2 * | 3/2004 | Marino | 206/362.2 |
| 6,769,542 | B2 * | 8/2004 | Polito | 206/361 |
| 7,156,476 | B2 * | 1/2007 | Helber | 312/242 |
| 7,290,651 | B2 * | 11/2007 | Irwin et al. | 206/216 |
| 8,342,326 | B1 * | 1/2013 | Steffes | 206/349 |
| 2002/0027402 | A1 * | 3/2002 | Hanser | 312/206 |
| 2004/0149608 | A1 * | 8/2004 | Laux et al. | 206/349 |
| 2005/0189249 | A1 * | 9/2005 | Wimmer | 206/349 |
| 2008/0197030 | A1 * | 8/2008 | Wang | 206/216 |
| 2008/0308438 | A1 * | 12/2008 | Giles | 206/349 |
| 2009/0260998 | A1 * | 10/2009 | Davidson et al. | 206/207 |

* cited by examiner

*Primary Examiner* — Steven A. Reynolds

(57) ABSTRACT

A storage container that contains bathroom cleaning utensils such as a plunger and toilet brush. The storage container may include an internal compartment, with a notch on the bottom surface of the bottom end. The notch may be shaped to fit around the edge of a toilet bowl. A channel may lead into the internal compartment. Therefore, a user may secure the storage container to the edge of the toilet bowl and either plunge or clean the toilet. Then the user may place the plunger or toilet brush into the compartment over the channel. Therefore, any dripping water may be caught by the channel.

9 Claims, 2 Drawing Sheets

STORAGE CONTAINER FOR BATHROOM CLEANING UTENSILS

CROSS-REFERENCE TO RELATED APPLICATION

This application claims the benefit of priority of U.S. provisional application number 61/694,558, filed Aug. 29, 2012, the contents of which are herein incorporated by reference.

BACKGROUND OF THE INVENTION

The present invention relates to a storage container and, more particularly, to a storage container for bathroom cleaning utensils.

A plunger is a common device that is used to release stoppages in plumbing. The tool consists of a rubber cup with an attached stick "shaft", usually made of wood or plastic. The cup is pushed down against the drain opening, and either pressed hard into the drain to force air in, or is pushed down until the rubber cup is flattened, then pulled out, causing a vacuum. The intent is to loosen or break up a clog caused by excessive material in the drain. A toilet brush may be used to clean the inside of the toilet bowl.

The toilet brush and the plunger tend to be unsightly in a bathroom. Further, after using a toilet brush and plunger, the devices are wet. Therefore, toilet water may drip off of the toilet brush and plunger and onto the toilet and/or the floor. Further, when stored in a compartment, the water may build up around the plunger and toilet brush, facilitating the growth of bacteria.

As can be seen, there is a need for a device that provides for a more sanitary method of using and storing a toilet brush and plunger.

SUMMARY OF THE INVENTION

In one aspect of the present invention, a storage container comprises: a first sidewall, a second sidewall, a back portion, a top, and a bottom, wherein an opening is formed to a compartment in between the first sidewall, the second sidewall, the back portion, the top and the bottom, wherein the compartment is sized to store at least one of a plunger and a toilet brush, wherein the bottom comprises an upper surface and a lower surface; a notch formed on lower surface of the bottom, wherein the notch is sized to fit around the edge of a toilet bowl; and a channel on the upper surface of the bottom, wherein the channel leads into the compartment.

These and other features, aspects and advantages of the present invention will become better understood with reference to the following drawings, description and claims.

DETAILED DESCRIPTION OF THE INVENTION

Figure 1:
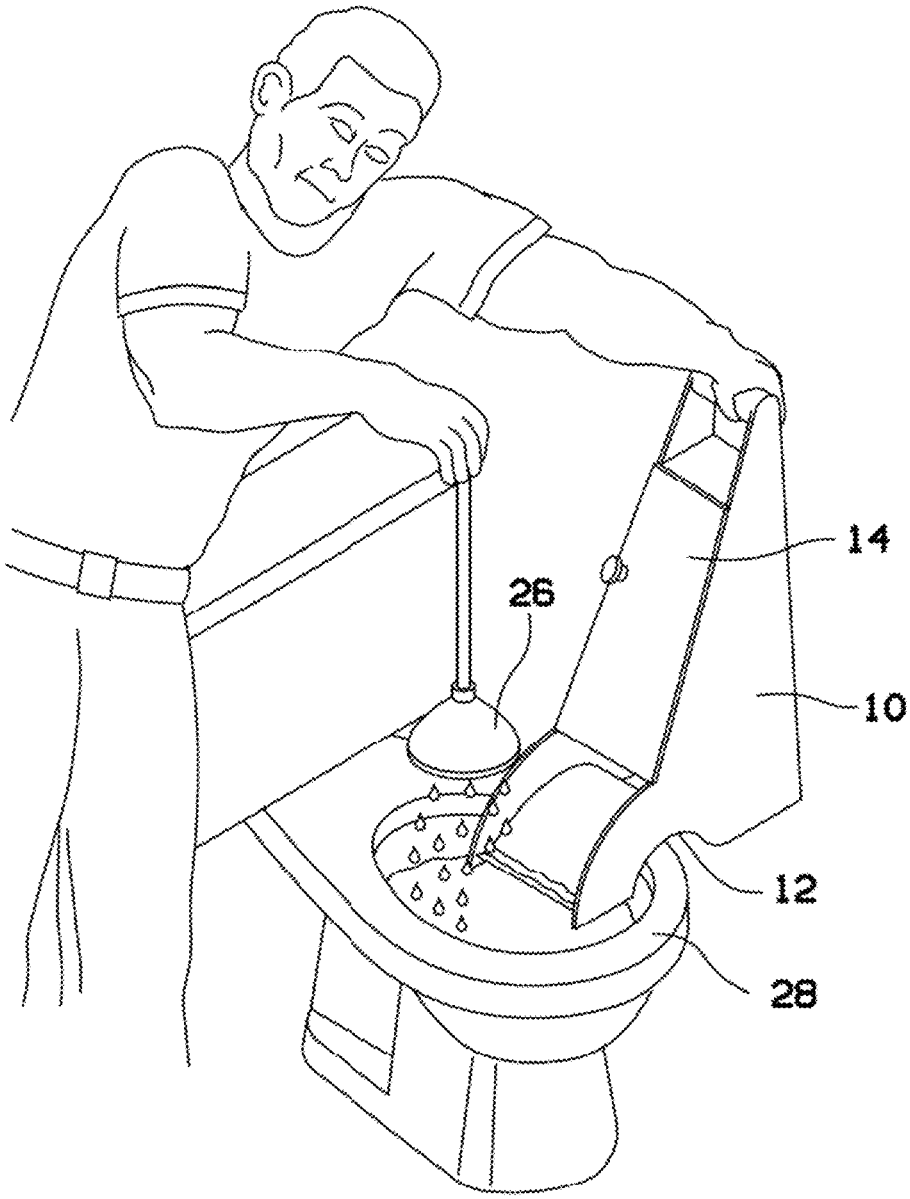
FIG. 1 is a perspective view of the present invention in use.
Figure 2:
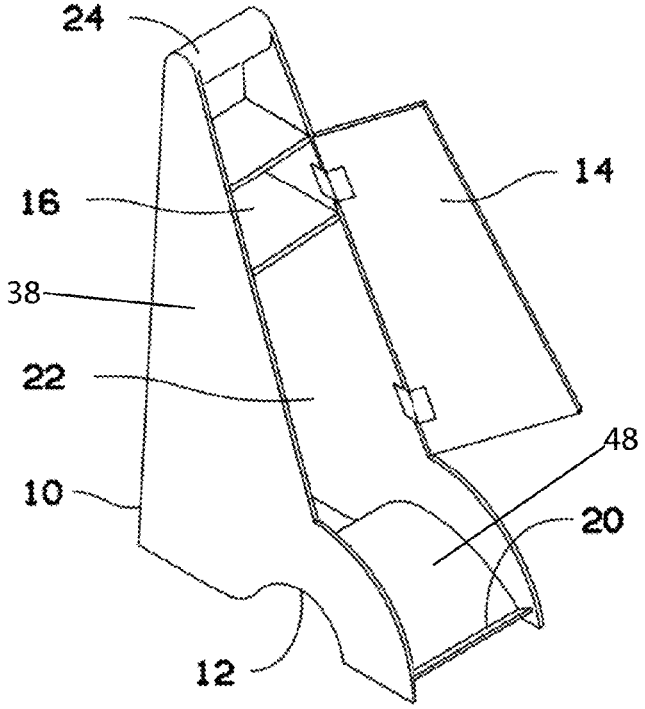
FIG. 2 is a perspective view of the present invention of FIG. 1, with an exemplary door in an open position.
Figure 3:
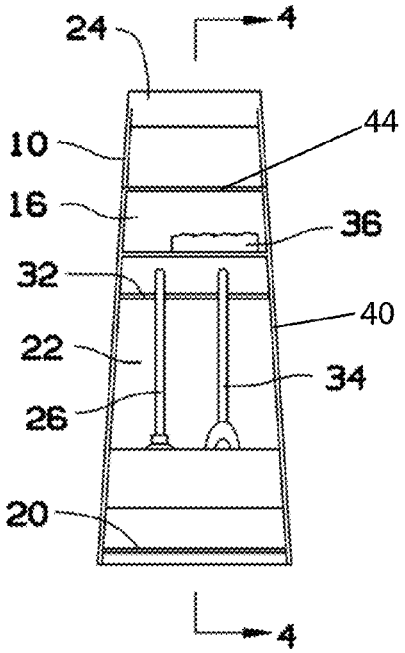
FIG. 3 is a front view of the present invention, without the door of FIG. 1.
Figure 4:
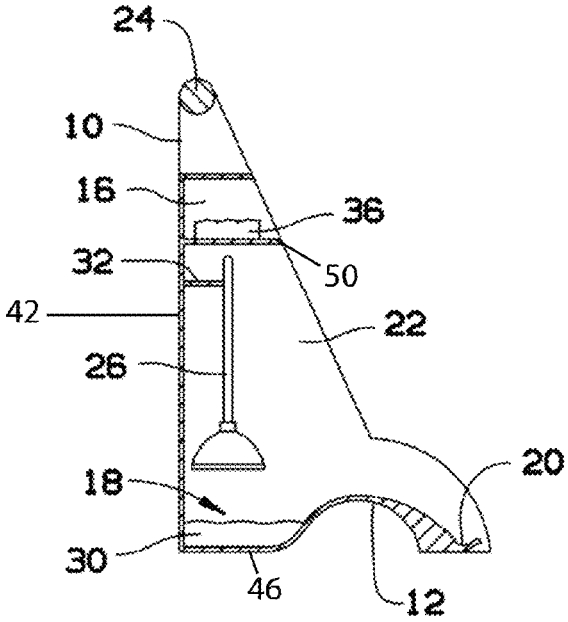
FIG. 4 is section view taken along line 4-4 of FIG. 3.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a storage container that contains bathroom cleaning utensils such as a plunger and toilet brush. The storage container may include an internal compartment, with a notch on the bottom surface of the bottom end. The notch may be shaped to fit around the edge of a toilet bowl. A channel may lead into the internal compartment. Therefore, a user may secure the storage container to the edge of the toilet bowl and either plunge or clean the toilet. Then the user may place the plunger or toilet brush into the compartment over the channel. Therefore, any dripping water may be caught by the channel.

The present invention may include a container that stores a plunger and toilet brush and prevents water from dripping onto the toilet or floor. Further, the present invention may keep the plunger and toilet brush out of sight and stored in a corner, organizing and sanitizing the bathroom. The present invention may also trap and drain accumulated water for a dry and sanitized storage.

Referring to FIGS. 1 through 4, the present invention may include a storage container 10. The storage container 10 may include a first sidewall 38, a second sidewall 40, a back portion 42, a top 44, and a bottom 46 forming an opening leading to a compartment 22. The compartment 22 may be sized to fit at least one of a plunger 26 and a toilet brush 34. The bottom 46 may include an upper surface and a lower surface. A notch 12 may be formed on the lower surface of the bottom 46. A channel 48 may be formed on the upper surface of the bottom 46 and extend from the opening. The channel may lead into the compartment 22.

The present invention may further include additional components on the outside of the storage container 10. As illustrated, the present invention may include a handle 24 formed at the top 44. The handle 24 may be used to easily grasp and maneuver the storage container 10. The present invention may further include a door 14 hinged to one of the first side wall 38 and the second sidewall 40. The door 14 may cover the opening and may be opened and closed using a knob. Therefore, the plunger 26 and the toilet brush 34 may be stored within the compartment 22 without being visible to a user.

In certain embodiments, the present invention may further include additional components within the storage container 10. As illustrated, the present invention may further include a divider 50 mounted within the compartment 22. The divider 50 may be mounted near the top 44 of the storage container 10. The divider 50 may thereby create a top compartment 16 and the bottom compartment 22. The top compartment 16 may store additional cleaning devices, such as sponges 36, cleaning gloves, additional brushes, and the like. The bottom compartment 22 may contain the plunger 26 and toilet brush 34.

The present invention may further include a storage bracket 32 mounted to the back portion 42 within the compartment 22. In certain embodiments, the plunger 26 and the toilet brush 34 may attach to and hang from the storage bracket 32. In such embodiments, a reservoir 18 may be formed within the compartment 22 below the storage bracket 32 and behind the notch 12. Therefore, the plunger 26 and the toilet brush 34 may hang from the storage bracket 32, and the moisture may drip from the plunger 26 and the toilet brush 34 into the reservoir 18, where the liquid 30 is collected. Therefore, the plunger 26 and toilet brush 34 may hang dry.

The notch 12 of the present invention may fit around the edge of a toilet bowl 28. Therefore, a user may grasp the handle 24 of the storage container 10 and place the notch 12 onto the edge of the toilet bowl 28 during use. In certain embodiments, the channel 48 may be formed along the notch 12. Therefore, the channel 48 may lead into the toilet bowl, as illustrated in FIG. 1. A raised lip 20 may be at the end of the channel 48 to catch any water still within the channel 48 after use.

A method of using the present invention may include the following. Once the user has placed the notch 12 onto the edge of the toilet bowl 28, the user may open the door 14 and remove either the plunger 26 or the toilet brush 34 to plunge or clean the toilet. Then, when the user is finished, the user may place the plunger 26 or toilet brush 34 back into the storage container 10 while holding the plunger 26 or toilet brush 34 over the channel 48. Therefore, any water that drips off of the plunger 26 or toilet brush 34 may be caught by the channel 48. The plunger 26 or toilet brush 34 may be hung from the storage bracket 32 and the door 14 may be closed. The storage container 10 may be placed on the bathroom floor and any additional moisture may drip from the plunger 26 or toilet brush 34 into the reservoir 18. The collected liquid 30 may be poured from the storage container 10 at any time. The compartment 22 may also be sprayed with sanitizer.

The present invention may be made with metal, molded plastic, or the like. The present invention may be made in two separate pieces, the container and the hinged door. In certain embodiments, the present invention may be modified and be used in many industries as a spill containment device. For example, the present invention may be used in labs using dangerous chemicals, the beverage industries, and restaurants.

It should be understood, of course, that the foregoing relates to exemplary embodiments of the invention and that modifications may be made without departing from the spirit and scope of the invention as set forth in the following claims.

What is claimed is:

1. A storage container comprising:

a first sidewall, a second sidewall, a back portion, a top, and a bottom, wherein an opening at a front end of the storage container is formed leading to a compartment in between the first sidewall, the second sidewall, the back portion, the top and the bottom, wherein the compartment is sized to store at least one of a plunger and a toilet brush, wherein the bottom comprises an upper surface and a lower surface;

a notch formed from the first sidewall to the second sidewall on the lower surface of the bottom, wherein the notch is sized to receive the edge of a toilet bowl; and a channel comprising two sidewalls formed on the upper surface of the bottom and protruding from the front end of the storage container, wherein the channel leads into the opening, wherein the channel and the notch are substantially perpendicular relative to one another.

2. The storage container of claim 1, wherein the top comprises a handle.

3. The storage container of claim 1, further comprising a divider mounted within the compartment near the top, wherein the divider creates a top compartment and a bottom compartment.

4. The storage container of claim 1, further comprising a door hinged to one of the first sidewall and second sidewall, wherein the door covers the opening.

5. The storage container of claim 1, further comprising a raised lip at an end of the channel.

6. The storage container of claim 1, wherein the channel is formed along the notch.

7. The storage container of claim 1, further comprising a storage bracket mounted within the container, wherein at least one of the plunger and the toilet brush are hung from the storage bracket.

8. The storage container of claim 1, further comprising a reservoir within the container and behind the notch.

9. The storage container of claim 1, wherein the lower surface of the bottom comprises a U-shaped curve forming the notch.

* * * * *